United States Patent [19]

Kagoura

[11] 4,142,750

[45] Mar. 6, 1979

[54] DOOR LATCH

[75] Inventor: Tetsuro Kagoura, Kurobe, Japan

[73] Assignee: Yoshida Kogyo K.K., Tokyo, Japan

[21] Appl. No.: 782,184

[22] Filed: Mar. 28, 1977

[30] Foreign Application Priority Data

Mar. 31, 1976 [JP] Japan ..... 51/38700[U]

[51] Int. Cl.[2] ..... E05C 3/14

[52] U.S. Cl. ..... 292/210; 292/336

[58] Field of Search ..... 292/210, 332, 333, 334, 292/335, 336

[56] References Cited

U.S. PATENT DOCUMENTS

| | | | |
|---|---|---|---|
| 1,774,260 | 8/1930 | Firestone et al. | 292/336 |
| 1,861,887 | 6/1932 | Stassart | 292/336 X |
| 2,698,197 | 12/1954 | Jacobson | 292/336 |

*Primary Examiner*—Richard E. Moore

*Attorney, Agent, or Firm*—Hill, Gross, Simpson, Van Santen, Steadman, Chiara & Simpson

[57] ABSTRACT

A door latch has a latch bolt for being pivotally mounted on a door for 90° angular movement between latched and unlatched positions, a retractable stop member pivotally mounted on the door and being spring biased for being engaged by the latch bolt for blocking the same in its unlatched position while the door is open. Upon closure of the door, the stop member engages an abutment adapted to be fixedly mounted on a doorframe and is thereby pivoted to a retracted position against the bias of the spring, so that the latch bolt is free to be moved between the latched and the unlatched positions only when the door is closed.

9 Claims, 4 Drawing Figures

DOOR LATCH

BACKGROUND OF THE INVENTION

1. Field of the Invention

This invention relates to door latches of the type having a latch bolt.

2. Description of the Prior Art

Heretofore, a latch bolt has been free to project or to be with drawn either when the door is open or closed. Thus, if the latch bolt projects out of the door when the door is being closed, the latch bolt will hit the doorframe, possibly resulting in the damage to the doorframe or to the latch bolt itself.

SUMMARY OF THE INVENTION

It is accordingly an object of this invention to provide an improved door latch of the type having a latch bolt, wherein the latch bolt is positively retained in its unlatched position while the door is open, so that the above described problem of the prior art is overcome.

Another object of the invention is to provide a door latch of the character specified which is simple and inexpensive in construction and which can be easily installed on a usual door and doorframe without any major alteration of their existing parts.

With these and other objects in view, this invention provides a door latch having a latch bolt adapted to be mounted on a door for movement between latched and unlatched positions, a stop member adapted to be mounted on the door for movement between a working position for blocking the latch bolt in the unlatched position and a retracted position for permitting the latch bolt to be moved freely between the latched and the unlatched positions, the stop member being urged by resilient means to move toward the working position, and an abutment adapted to be secured to a doorframe whereby the stop member is moved from the working to the retracted position against the force of the resilient means in response to the door's being swung to a closed position within the doorframe.

Thus the latch bolt is permitted to move between the latched and the unlatched positions only when the door is in the closed position within the doorframe. When the door is opened, the latch bolt is positively retained in the unlatched position by the stop member since the latter is then moved to and maintained in the working position by the resilient means.

Many other advantages and features of the present invention will become manifest to those versed in the art upon making reference to the detailed description and the accompanying sheet of drawings in which a preferred structural embodiment incorporating the principles of the present invention is shown by way of example.

DESCRIPTION OF THE PREFERRED EMBODIMENT

Figure 1:
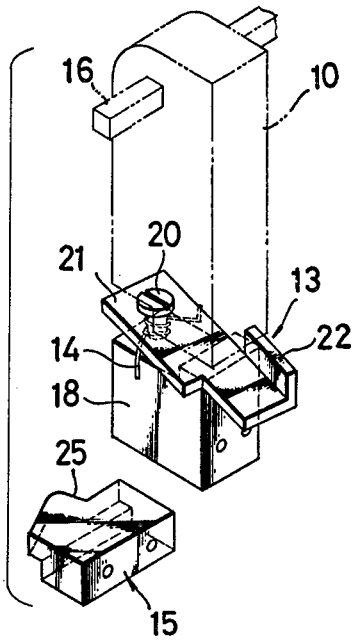
FIG. 1 is a perspective view showing constituent parts of a door latch embodying the features of this invention.
Figure 2:
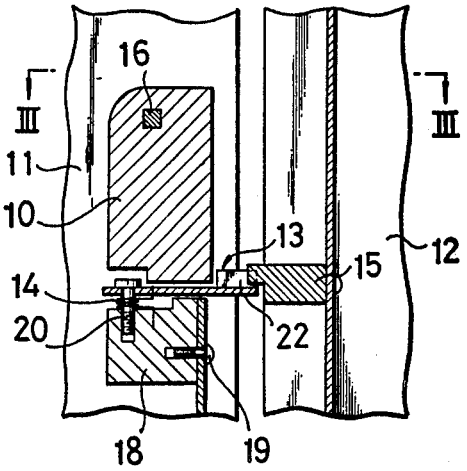
FIG. 2 is a vertical cross-sectional view showing the door latch of FIG. 1 as installed on a door and doorframe.

In FIGS. 1 and 2, the door latch is of the type having a latch bolt 10 which is selectably angularly displaceable 90° (in a counter-clockwise direction in FIG. 2) for holding a swinging door 11 in a closed position within a doorframe 12 as desired.

Broadly, the illustrated door latch further comprises a stop member 13 pivotally mounted on the door 11 for movement into and out of a position where it can be engaged by the latch bolt 10, a torsion spring 14 for holding the stop member in a blocking position with respect to the latch bolt 10 when the door is open, and an abutment 15 on the doorframe 12 for enabling the stop member to move out of such blocking position against the force of the torsion spring in response to the door's being closed.

The latch bolt 10 has a substantially integral pivot pin 16 which extends horizontally and which is suitably supported for being pivoted on one of the stiles of the door 11. The latch bolt 10 is therefore pivotable in a vertical plane about a horizontal axis between an unlatched position shown in FIGS. 2 and 4, where the latch bolt is disposed vertically within the door 11 to permit it to be opened, and a latched position indicated by the broken lines in FIG. 3, where the latch bolt is disposed horizontally and is partly received in a socket formed in the doorframe 12 for holding the door closed.

Beneath the latch bolt 10, a stop mount 18 is secured to the said one stile of the door 11 by means of machine screws 19. On the top of the stop mount 18, the stop member 13 is pivotally mounted by a machine screw 20 for pivotal movement in a horizontal plane about a vertical axis between a working or blocking position shown in FIG. 4, where the stop member locks the latch bolt 10 in the unlatched position, and a retracted position shown in FIG. 3, where the stop member permits the latch bolt 10 to move freely between the latched and the unlatched positions.

As best seen in FIG. 1, the stop member 13 comprises a substantially rectangular major portion 21 extending horizontally and pivotally supported at one end by the screw 20 on the mount 18, and an upstanding portion 22 formed on the other or free end of the major portion projecting beyond the lower end of the latch bolt 10 when the latter is in the unlatched position. The upstanding portion 22 is adapted to be engaged by the latch bolt 10 for blocking or locking same in the unlatched position when the stop member 13 is in the working position, as shown in FIG. 4.

Coiled around the screw 20, the torsion spring 14 has one of its ends engaged with the major portion 21 of the stop member 13 and the other end with the mount 18, so that the stop member is yieldably urged from the retracted to the working position. That is, the stop member 13 is urged by the torsion spring 14 in the same direction in which the door 11 is swung to the closed position within the doorframe 12, as indicated by the arrow in FIG. 4.

Figure 4:
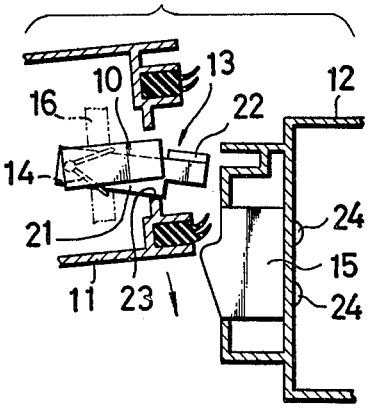
FIG. 4 is a view similar to FIG. 3 but showing the door opened and the stop member of the latch in its working position.

As shown in FIG. 4 when the door 11 is open, the stop member 13 is urged by the torsion spring 14 against an edge 23 of the said one door stile bounding an opening therein through which the latch bolt 10 and the stop member 13 project outwardly. Thus, as long as the door 11 is open, the stop member 13 is maintained in the working position to block any pivotal movement of the latch bolt 10 toward the latched position.

Figure 3:
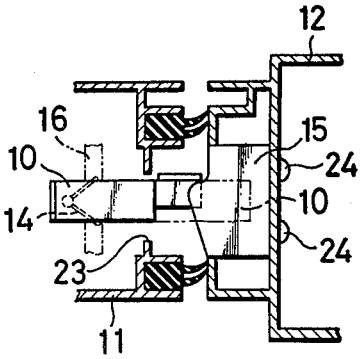
FIG. 3 is a horizontal cross-sectional view taken along line III—III of FIG. 2, the view showing the door closed and the stop member of the latch in its retracted position.

On one of the vertical members of the door frame 12, the abutment 15 is fixedly mounted by means of a pair of screws 24, 24 in FIGS. 3 and 4 in such a position that the abutment 15 is disposed opposite to the stop member 13. As best shown in FIG. 1, the abutment 15 has a step 25 for being engaged by the side of the upstanding portion 22 of the stop member 13 in response to the door's 11 being closed. The stop member 13 is therefore automatically moved from the working to the retracted position by reaction from the abutment 15 against the force of the torsion spring 14 in response to the door's 11 being swung to the closed position.

When the door 11 is closed as shown in FIG. 3, the stop member 13 is retained in the retracted position by the abutment 15 against the force of the torsion spring 14. The latch bolt 10 is then free to be pivoted between the latched and the unlatched positions by any known or suitable means, not shown, without being obstructed by the stop member 13.

When the door 11 is to be opened as shown in FIG. 4, the latch bolt 10 is pivoted. Then when door opening begins, the stop member 13 is pivoted from the retracted to the working position by the torsion spring 14, so that the upstanding portion 22 of the stop member is moved to the position where its edge is engageable with the latch bolt 10. As long as the door 11 is open, there is no possibility of the latch bolt 10 being pivoted inadvertently from the unlatched position.

Although various minor modifications may be suggested by those versed in the art, it should be understood that I wish to embody within the scope of the patent warranted hereon, all such embodiments as reasonably and properly come within the scope of my contribution to the art.

I claim:

1. A latch for use on a door swingably mounted within a doorframe, comprising:

(a) a latch bolt structurally adapted to be mounted on the door for free pivotal movement about a horizontal axis between a latched position in which said latch bolt has a portion projecting out of the door into the doorframe for holding the door closed within the doorframe and an unlatched position in which said latch bolt portion is disposed in the door for permitting the door to be opened;

(b) a stop mount structurally adapted to be fixedly secured to the door;

(c) a stop member mounted on said stop mount in normally spaced relation to said latch bolt for pivotable movement about a vertical axis between (1) a working position wherein a portion thereof is in the path of said latch bolt portion for blocking said latch bolt portion against movement out of said unlatched position, and (2) a retracted position spaced from said latch bolt and from the path of said latch bolt portion for permitting said latch bolt to be moved freely between said latched and said unlatched positions without engaging said stop member;

(d) resilient means urging said stop member to pivot toward said working position; and (e) an abutment structurally adapted to be mounted on said doorframe within the doorframe opening in spaced relation to the path of the latch bolt portion and engageable only with said stop member to cause it to move from said working position to said retracted position against the force of said resilient means in response to the door's being swung to a closed position within the doorframe, and it to be moved back to said working position by said resilient means in response to the door's being swung out of the doorframe; whereby said latch bolt is movable into and out of said latched position only when the door is in the closed position within the doorframe.

2. A latch according to claim 1 in which said stop member is pivotable about a vertical axis between said working and said retracted positions, said stop member being urged by said resilient means in the same direction as the door is to be swung to the closed position within the doorframe.

3. A latch according to claim 1, said abutment being adapted to be engaged by said upstanding portion of said stop member for effecting movement of it from said working position to said retracted position.

4. A latch according to claim 1 in which said stop member has a horizontally extending pivotally mounted major portion adapted to project at all times from the door at one end remote from its pivotal support, and having an upstanding portion on said projecting end of said major portion and disposed to be moved into and out of said path of said latch bolt portion, said upstanding portion being engageable by said latch bolt portion for blocking said latch bolt from being moved out of said unlatched position when said stop member is in said working position.

5. A latch according to claim 1, said latch bolt being structurally adapted to be pivotally mounted at one end, the other end of said latch bolt including said latch bolt portion being engageable with said stop member only in response to any attempted movement of said latch bolt to its latched position, and only when the door is not closed.

6. A latch according to claim 5, said stop member having a horizontally extending major portion out of said path of said latch bolt portion, and an upstanding portion engageable by said latch bolt portion.

7. A latch according to claim 6, said abutment extending partly over said major portion during engagement with said upstanding portion.

8. A latch according to claim 4, said latch bolt portion being positionable over said horizontally extending major portion of said stop member when said latch bolt is in said unlatched position.

9. In a combination:

(a) a doorframe;

(b) a door mounted within an opening of said doorframe, and pivotable about a vertical axis; the improvement comprising:

(c) a latch bolt mounted on the door for free pivotal movement about a horizontal axis between a latched position in which said latch bolt has a portion projecting out of said door into said doorframe, and an unlatched position in which said latch bolt portion is disposed in said door;

(d) a stop mount disposed within and fixedly secured to said door;

(e) a stop member mounted on said stop mount in normally spaced relation to said latch bolt for pivotable movement about a vertical axis between (1) a working position wherein a portion thereof is in the path of said latch bolt portion for blocking said latch bolt portion against movement out of said door, and (2) a retracted position spaced from said latch bolt and from the path of said latch bolt portion for permitting the latch bolt to be moved freely between said latched and said unlatched positions without engaging said stop member so long as said door is closed;

(f) resilient means urging said stop member to pivot toward said working position; and (g) an abutment mounted on said doorframe within its opening in spaced relation to the path of said latch bolt portion and engageable only with said stop member for moving it from said working position to said retracted position against the force of said resilient means in response to said door's being swung to a closed position within said doorframe, and to be moved back to said working position by said resilient means in response to said door's being swung out of said doorframe; whereby said latch bolt can be moved only when said door is in its closed position.

* * * * *